United States Patent [19]

Jackson et al.

[11] Patent Number: 4,469,075

[45] Date of Patent: Sep. 4, 1984

[54] VAPOROUS GASOLINE FUEL SYSTEM AND CONTROL THEREFOR

[75] Inventors: Kenneth A. Jackson, Wooster; George I. Arndt, Loudonville; James L. Maynard, Wooster, all of Ohio

[73] Assignee: V.G.A.S., Inc., Wooster, Ohio

[21] Appl. No.: 411,415

[22] Filed: Aug. 25, 1982

[51] Int. Cl.[3] ..... F02M 17/18

[52] U.S. Cl. ..... 123/523; 123/524; 123/440; 123/557

[58] Field of Search ..... 123/557, 552, 523, 522, 123/524, 440, 590

[56] References Cited

U.S. PATENT DOCUMENTS

| | | | |
|---|---|---|---|
| 1,278,946 | 9/1918 | Langworthy | 123/522 |
| 2,461,411 | 2/1949 | Cumming | 123/522 |
| 2,565,767 | 8/1951 | Gaskell | 123/522 |
| 3,713,429 | 1/1973 | Dwyre | 123/522 |
| 4,230,082 | 10/1980 | Jurschewitz | 123/522 |
| 4,312,317 | 1/1982 | Jewett | 123/522 |
| 4,380,985 | 4/1983 | Otsuka | 123/440 |
| 4,397,286 | 8/1983 | Jackson | 123/523 |
| 4,412,521 | 11/1983 | Silva | 123/524 |

*Primary Examiner*—Ronald H. Lazarus

*Attorney, Agent, or Firm*—Baldwin, Egan, Walling & Fetzer

[57] ABSTRACT

A fuel system and electronic control therefor which is especially designed for use with an internal combustion engine or the like in which said fuel system is operable to provide fuel fumes or vapor to the engine from a source of liquid ignitable vaporizable fuel, such as gasoline, of sufficient quantity whereby to significantly increase the efficiency of the engine and thus substantially increase the per gallon mileage rate for the engine when used in an automotive vehicle or the like, and one using liquid fuel as the original fuel source. The system incorporates an electronic control operable to monitor a plurality of engine parameters and which control is responsive to a change in engine demand for said fuel and resultant change in one or more of said engine parameters to maintain the optimum ratio of vaporized fuel and air in the mixture delivered to the engine for combustion.

16 Claims, 9 Drawing Figures

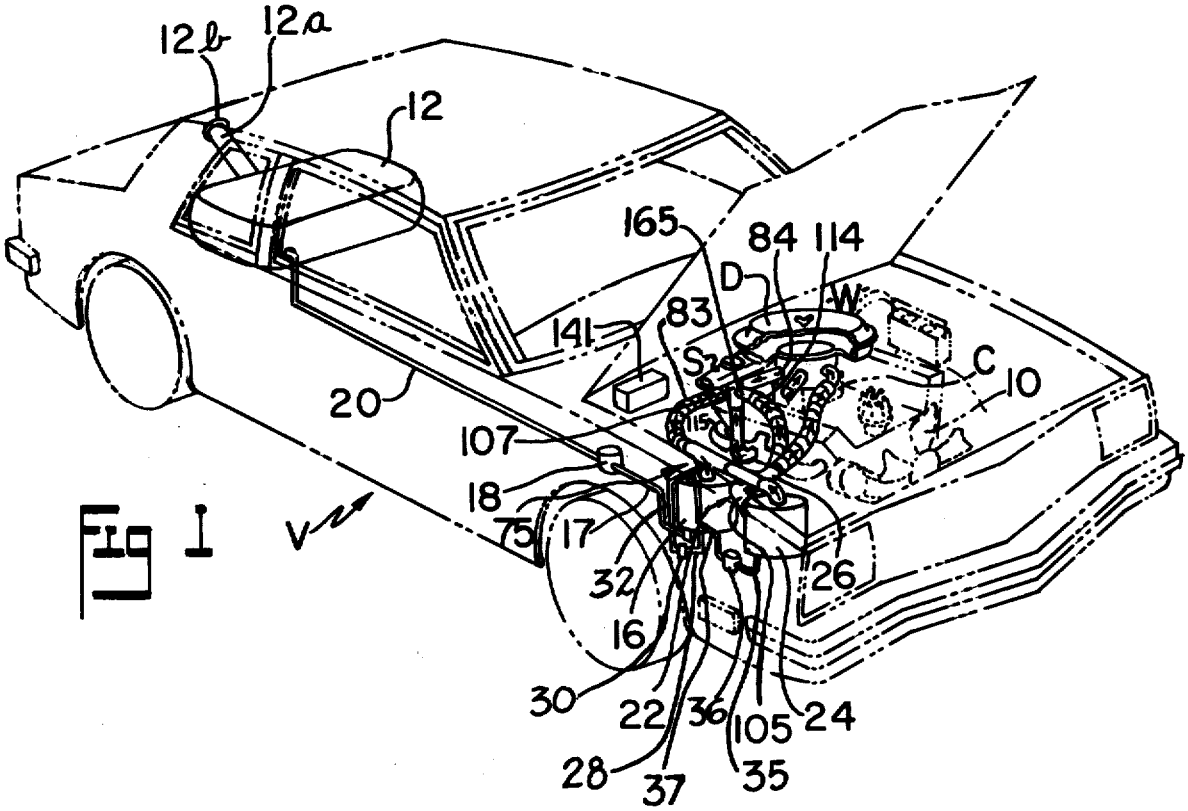
Fig 1
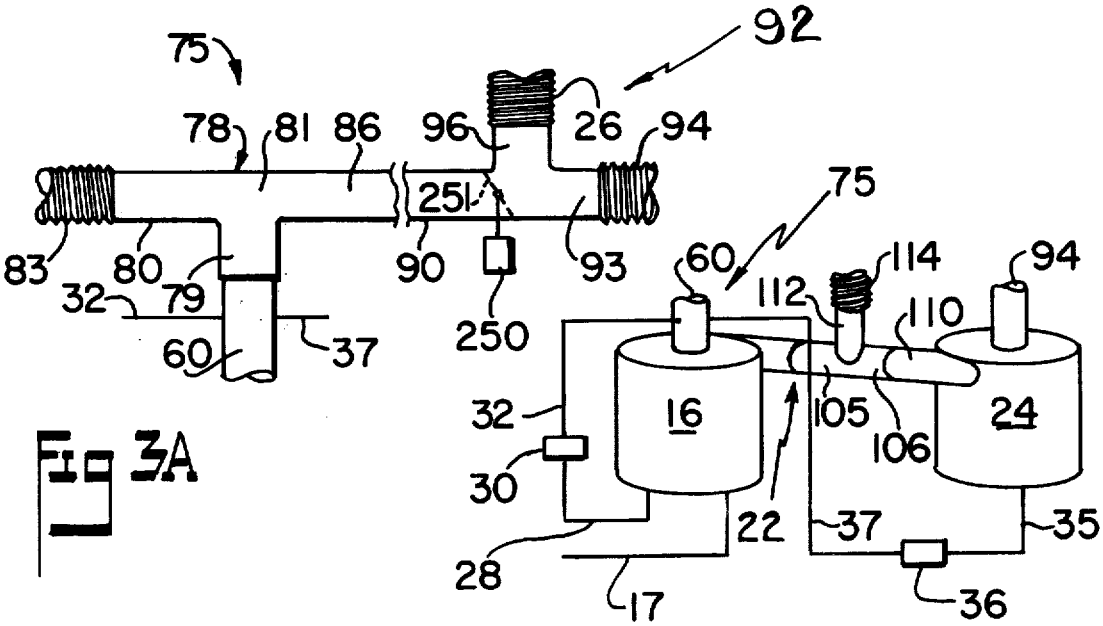
Fig 3A
Fig 1A

VAPOROUS GASOLINE FUEL SYSTEM AND CONTROL THEREFOR

This invention relates to a new and novel fuel system and more particularly to a fuel system especially designed for use with internal combustion engines or the like, and which fuel system is operable therewith to provide fuel fumes to the engine from a source of liquid ignitable vaporizable fuel, such as gasoline, and of sufficient quantity and mixture with air whereby to significantly increase the efficiency of the engine, to thus substantially increase the per gallon mileage rate for the engine when used in an automotive vehicle or the like, and using the liquid fuel as an original fuel source. This fuel system is provided with an electronic monitoring and control system especially operable to monitor a plurality of engine parameters as for example the combustion of the vaporized fuel and air delivered to the engine, engine coolant temperature, engine RPM, and manifold vacuum and which parameters may result in a change in the engine demand for said fuel and whereby the present fuel system is responsive to said parameters and under the control of said control system to maintain the optimum ratio of fuel and air in said vaporized fuel mixture delivered to the engine for combustion under various conditions of load.

BACKGROUND OF THE INVENTION

It is recognized in the art that the efficiency of the typical internal combustion engine in present use in automotive vehicles and the like is approximately twenty-five percent or less when using liquid fuel such as gasoline or other like ignitable fuels, such as for instance pentane, hexane, heptane, octane, nonane, decane, undecane, dodecane, tetra decane, hexadecane, octadecane and crude oil.

Typical prior art fuel systems are exemplified in U.S. Pat. Nos. 983,646; 1,470,204; 3,338,223; 3,749,376; 3,854,463; 4,204,485; 4,200,064; 3,790,139; 3,999,526; 4,074,666; 4,076,002 and 4,177,779.

In the use of any such liquid fuel with an associated internal combustion engine it is well recognized that a substantial percentage of said fuel is not utilized by the engine for power generation, but instead is expelled from the engine and/or burned or consumed in the exhaust system thereof.

In applicants Kenneth A. Jackson and George I. Arndt's copending application Ser. No. 151,170, filed May 19, 1980 now U.S. Pat. No. 4,366,797 issued Jan. 4, 1983, and in application Ser. No. 229,348 filed Jan. 29, 1981 now abandoned, there are disclosed novel fuel systems which materially increase the efficiency of an internal combustion engine, and in the assignee's copending application Ser. No. 173,605 filed Aug. 1, 1980 now U.S. Pat. No. 4,368,712 there is disclosed a novel fuel system and electronic control therefor.

The prior art identified therein is incorporated herein, without specifically listing the same. The present invention is an improvement of a system of the type disclosed in application Ser. Nos. 151,170, 229,348 and 173,605.

BRIEF DESCRIPTION OF THE INVENTION

Briefly, the present invention provides a fuel system and electronic control therefor for use with an internal combustion engine or the like wherein fuel fumes are generated from a liquid source of ignitable fuel such as gasoline, or similar liquid vaporizable fuel, and presented in a fumed state to the engine for consumption and power conversion therein, and wherein the system is provided with improved means for fuming the liquid fuel.

Substantially all of the fumed fuel presented to the engine is consumed therein for power conversion, thus resulting in substantially increasing the efficiency of the engine and hence substantially increasing the mileage rate per gallon of liquid fuel.

It is therefore a primary object of the present invention to provide a fuel system especially designed for use with an internal combustion engine of an automotive vehicle adapted to utilize liquid ignitable fuel and which system is operable to generate fuel fumes in an improved manner from the liquid fuel, and to provide fumes of sufficient quantity to the engine, whereby to significantly increase the efficiency of the engine, to thus substantially increase the automotive vehicle per gallon mileage rate of the liquid fuel.

Another object of the present invention is to provide an electronic control for use with the fuel system and which is operable to monitor a plurality of engine parameters and responsive to a change in engine demand to maintain the optimum ratio of the mixture of vaporized fuel and air delivered to the engine.

Another object of the present invention is to provide an electronic control which is operable to monitor a plurality of engine parameters as for example engine coolant temperature, engine RPM, engine manifold vacuum, and the exhaust gases of combustion, said control being responsive to a change in engine demand as represented by a change in one or more of said engine parameters to maintain the optimum ratio of the mixture of vaporized fuel and air delivered to the engine under various engine loads.

Still another object of the present invention is to provide a fuel system as hereinabove referred to which is operable at atmospheric pressure and which utilizes the vacuum or suction generated by the engine, to provide the fuel fumes to the engine.

Other objects and advantages of the invention will be apparent upon reference to the following description taken in conjunction with the accompanying drawings, which illustrate preferred embodiments thereof.

BRIEF DESCRIPTION OF PREFERRED EMBODIMENT

The fuel system of this invention provides fumed fuel from a source of liquid fuel such as gasoline or like liquid ignitable fuel, many of which are hereinabove referred to, to an internal combustion engine.

As one preferred embodiment, it is herein described, for use with an automobile wherein "fumed gasoline fuel" is generated in an auxiliary or fume tank, which may coact with a main liquid fuel tank, and is mixed with air. This fuel-air mixture is then passed into and through a liquid trap wherein it is intended that any liquid fuel droplets or the like still present in said mixture may be removed and the dried fuel-air mixture is then supplied to the fuel input to the engine such as the carburetor of the engine, for powering the latter. The fume tank is controllably vented or connected to atmosphere, to provide suitable quantities of air for fuming and mixing with the vaporous fuel, and improved means are provided for accomplishing the fuming of the liquid fuel. The present system incorporates an electric control which is operable to monitor a plurality of engine parameters, as for example the above described parameters, each of which may vary in response to a change in engine demand as sensed by said control and wherein said control is operable to correspondingly modify the fuel-air mixture delivered to the engine being thus operable to maintain the optimum ratio of the vaporized fuel and air in said mixture under varying engine load conditions.

BRIEF DESCRIPTION OF THE DRAWINGS

FIG. 1 is an illustration in perspective of a conventional passenger type motor vehicle with the fuel system of the present invention disposed in the engine well;

FIG. 1A is a somewhat schematic view showing several components of the present system including the fuming tank, the liquid trap and the interconnections therebetween;

FIG. 3A is a partial side elevational view showing the inlet head assembly for the fuming tank;

DESCRIPTION OF PREFERRED EMBODIMENT

Figure 2:
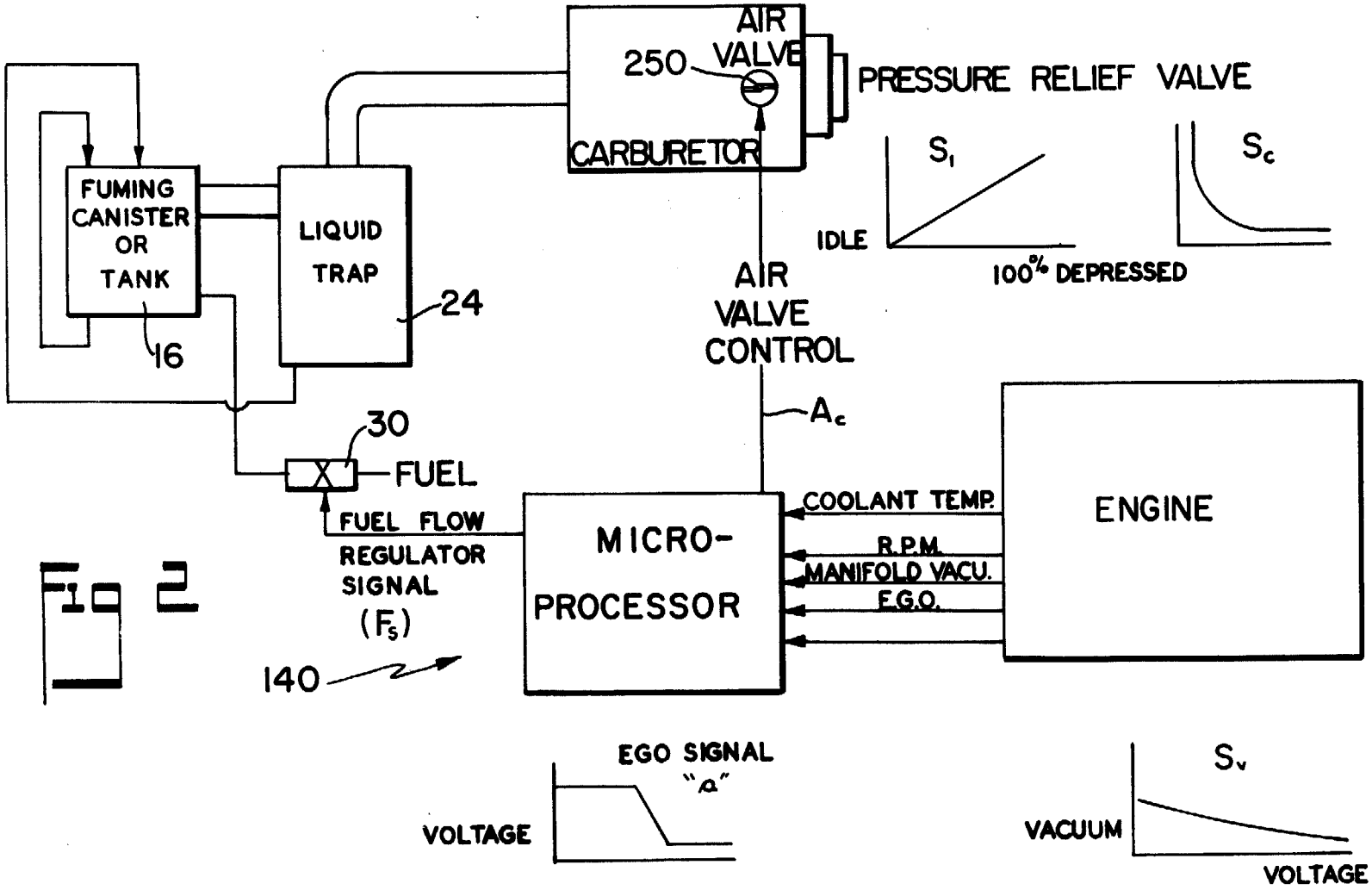
FIG. 2 is a schematic view showing the assembly of the present fuel system and the microprocessor control therefor.

While the fuel system illustrated is particularly adapted for use with an internal combustion engine is an automotive vehicle type of environment, it is also contemplated that said system may be adaptable to an internal combustion engine in varied environments such as tractors, stationary power units, off-the-road equipment, and the like.

As herein illustrated, and as also disclosed in applicants' copending application Ser. No. 229,348 a typical automobile vehicle V is shown in FIG. 1 equipped with an internal combustion engine 10 designed to burn liquid ignitable fuel supplied by a more or less conventional fuel tank (e.g. tank 12 having liquid fuel inlet 12*a* and conventional vented cap 12*b*) for providing liquid fuel such as gasoline or any other liquid vaporizable ignitable fuel, to the carburetor 13 of said engine.

As aforementioned, with the fuel such as gasoline being supplied to the engine 10 in its liquid state, the engine only uses about 25-30 percent of said fuel for power conversion whereby the major part of said fuel is wasted and emitted in various well known pollutant forms from said engine.

The improved fuel system of the present invention, as aforementioned, is operable to overcome this deficiency by providing ignitable fuel in its "fumed or vaporous state" such that substantially all of the delivered fuel to said engine is utilized for power conversion.

To accomplish this, as seen in FIG. 1 the present system comprises in its basic concept a fuming tank 16 connected at one end of fuel line 17, the opposite end of the latter connecting to the outlet port of fuel pump 18. Fuel line 20 connects at one end to the inlet port of fuel pump 18, and the opposite end of said line 20 connects to the conventional fuel tank 12.

When pump 18 is actuated, in a manner to be described, liquid gasoline fuel from the main tank 12 is pumped into the bottom of the fuming tank 16 to form a bath of liquid fuel which in a typical installation may comprise approximately 6 fluid ounces.

The outlet of fuming tank 16 is connected, in turn, by conduit 22 to the input port of a liquid trap 24, and the outlet of said trap connects by conduit 26 to the conventional carburetor C.

One end of conduit 28 connects to the interior of fuming tank 16 at a level communicating with the fuel bath disposed in the bottom of said tank 16. The other end of conduit 28 connects to the inlet of electric pump 10. The pump outlet is connected, in turn, to one end of conduit 32, the opposite end of said conduit connecting to the inlet misting head assembly 75 of the fuming tank.

Conduit 35 has its one end communicating with the reservoir of the liquid trap 24 and its opposite end connects to the input of fuel pump 36. Conduit 37 is connected at one end to the inlet (head assembly 75) of the fuming tank 16 being thus operable to recycle any liquid fuel from said trap and to return the same to the input of the fuming tank for "revaporization".

In operation, in the novel fuel system as thus far briefly described, liquid fuel is pumped from the main tank 12 by pump 18 and into the bottom of the fuming tank 16 to form the liquid bath which, as aforementioned, may be approximately 6 fl. ounces of liquid fuel. Suitable control means such as a level sensor may be placed into the bath and is operable to control the volume and replenishment of liquid fuel of said bath. As more fully described hereinafter, the fuel pump 30 may be periodically pulsed by said control means to provide sufficient fuel to the inlet of the fuming tank 16 from the fuel bath in tank 16.

When the engine requires fuel, as will be hereinafter described, electric pump 30 is energized to draw liquid fuel from the aforesaid bath and through conduit 32 into the misting head assembly 75 of the fuming tank 16. When this occurs, the fuming tank 16 and liquid trap 24 which are connected in series relation to each other and to the carburetor C, are under the influence of the engine vacuum and hence said liquid fuel is drawn into the fuming tank 16 through the misting or fogging head assembly identified at 75 along with a controllable amount of air, in a manner as will be later described. The misted fuel and controllable air are thus initially mixed and as this mixture is drawn through the tank 16 under the influence of the engine vacuum a cyclonic or swirling type of mixture thus occurs and the fuel of such mixture is substantially vaporized. This mixture is then drawn by said engine vacuum through outlet conduit 22 and into the liquid trap 24 whereby any liquid fuel droplets which may still be in this vaporized fuel-air mixture are removed and separated therefrom and recycled through conduit 35, pump 36, and conduit 37 back to the inlet of the fuming tank 16 for revaporization.

The resultant dry vaporous fuel-air mixture is then drawn by the engine vacuum through conduit 26 and into the carburetor C for use in powering the engine 10.

It is also contemplated that one end of fuel line 17 instead of being connected to the bottom of the fuming tank 16 may be connected directly to the inlet (misting head assembly 75) of the fuming tank 16 whereby liquid fuel may be pumped by fuel pump 18 directly into the inlet of the fuming tank, and the fuel bath of liquid fuel in said tank may be eliminated.

The present invention also incorporates an electronic control which is identified at 140 which will be referred to in detail hereinafter and which, in its present form, as best seen in FIG. 2, comprises a microprocessor capable of monitoring a plurality of engine parameters and which is responsive thereto to provide a corresponding modulation of the fuel and air provided to the system and thus maintain an optimum combustible fuel-air mixture for various engine loading conditions.

Figure 5:
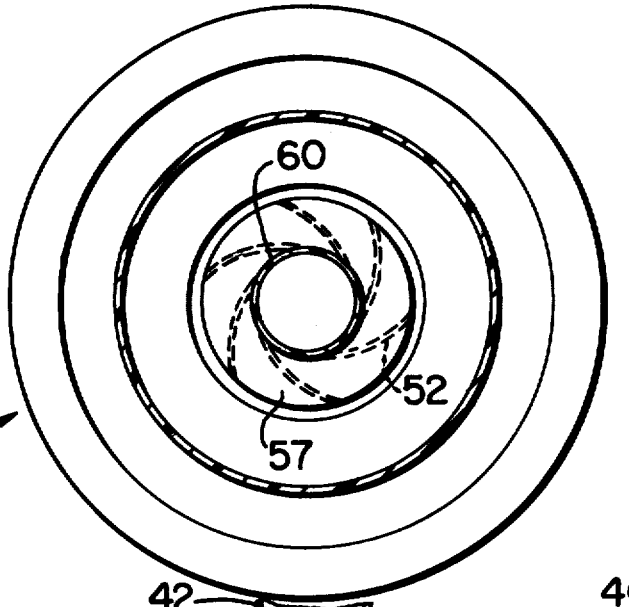
FIG. 5 is a sectional view taken on line 5—5 of FIG. 3.
Figure 3:
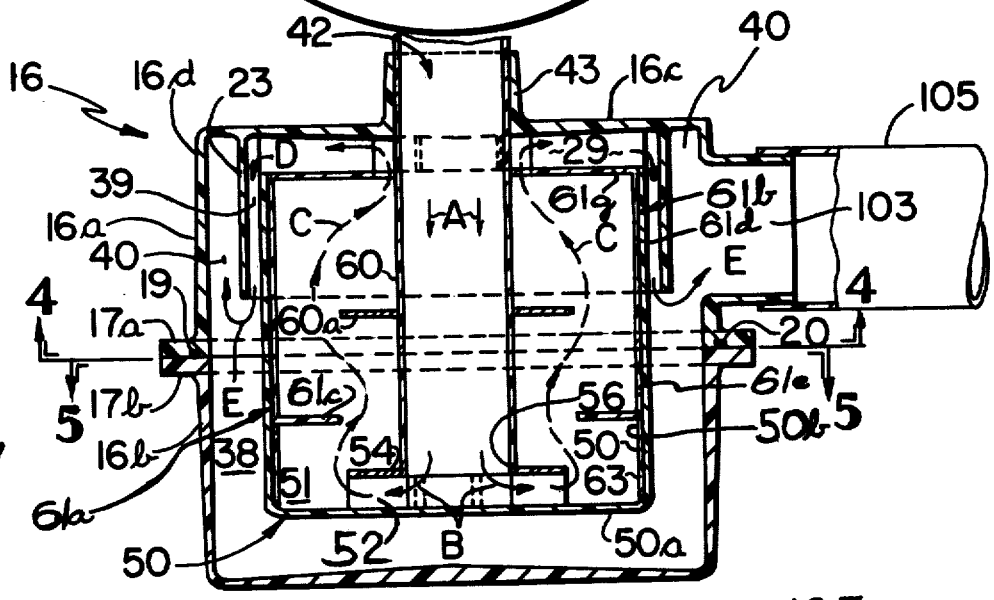
FIG. 3 is a side elevational view, partly in section, of the fuming tank assembly.
Figure 4:
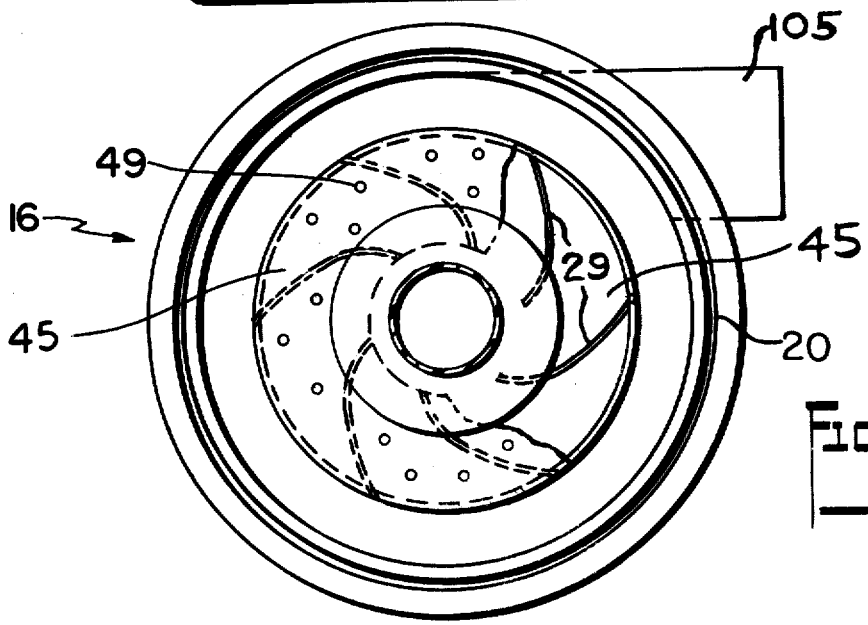
FIG. 4 is a sectional view taken on line 4—4 of FIG. 3.

With reference now directed to FIGS. 3–5 the fuming tank 16 is cylindrical in configuration and being preferably molded of a plastic material that is insensitive to gasoline vapors and other materials normally found in the environment of an internal combustion engine, said tank 16 being formed in its present configuration of an upper shell 16*a* and a lower shell 16*b*, each of which has a peripheral rim 17*a*, 17*b*, respectively, formed on its open end. As seen in FIG. 3 the tank shells are mounted together with their rims 17*a*, 17*b* in abutting registry to form tank chamber 38. Suitable sealing means such as O-ring 19 disposed in accommodating groove 20 formed in the adjoining surface of the rim 17*a*, provides an air-tight seal therebetween effective to seal the chamber 38 from atmosphere.

The upper shell 16*a* is provided with a shroud 23 which may be formed integrally with the top wall 16*c* and extends downwardly into the chamber 38, in parallel spaced relation and inwardly of the side wall 16*d* to form an annular exit chamber 40 which also communicates with chamber 38.

As best seen in FIGS. 3 and 4, the top wall 16*c* of the upper shell 16*a*, is integrally formed, such as by molding or the like, with a plurality of arcuately extending vane elements 29 which project downwardly from the top wall 16*c* and into chamber 38. The inner end of each vane element terminates outwardly from and in spaced relation to the peripheral surface of tube 60 extending through inlet port 42 as defined by a hollow upstanding cylindrical boss or flange 43 formed centrally in the top wall 16*c*, said tube 60 projecting centrally into the tank 16. The outer end of each vane element 29 is also seen to terminate in spaced relation to the adjacent inner surface of shroud 23.

An open-ended cylindrical cup member 50, preferably formed of the same plastic material as tank 16, is disposed centrally within the chamber 38 with the open end thereof abutting the bottom edges of vane elements 29. In assembly, the cup member 50 may preferably be securely affixed by suitable adhesive material or sonic welding or the like to the vane elements 29, to thus form a cup chamber 51 therein.

As seen in FIGS. 3 and 5, the bottom or closed end 50*a* of the cup member 50 is preferably integrally centrally formed with a plurality of upstanding arcuately extending vane elements 52, the outer end of each element terminating inwardly in spaced relation to the side wall 50*b* of cup member 50.

A flat circular plate 54 is placed over the upper edge of the vane elements 52, being suitably attached thereto by adhesive, sonic welding or the like, and has a circular aperture 56 formed therein as best seen in FIG. 3. The inner end of each vane element 52 terminates at the edge of the plate aperture 56.

Arcuate passageways 57 are thus formed by said vane elements 52 between the bottom wall 50*a* of the cup member 50 and plate 54, which, as best seen in FIGS. 3 and 5, radiate outwardly from the center of the tube 60 and communicate at their outer ends with chamber 51.

The aforementioned elongated tube or conduit 60 is disposed in and through the central boss or flange 43 of the upper shell 16*a*, and extends to the top surface of plate 54 to which it is securely fastened. Alternatively, tube 60 and plate 54 may be suitably molded of a plastic material in one piece and then secured to the upper edge of the vane elements 52.

As seen in FIG. 3, in this assembly, the outer diameter of the tube 60 is such as to be a tight fit with respect to the port 42 formed in the hollow boss or flange 43. The tube preferably extends upwarly out of the flange 43 and a suitable adhesive-sealing material placed around the top of the flange and adhesively engaging the outer surface of the tube securely fastens said tube in place and provides a suitable liquid-tight seal therebetween.

A deflector ring 60*a* is seen to be attached to or suitably formed on the outer surface of tube 60 intermediate its ends and extends radially outwardly into the chamber 50, perpendicularly to the tube axis and terminating in spaced relation to the inner surface of the side wall 50*b* of chamber 50. Said deflector ring 60*a* may alternately be molded integrally with tube 60.

A pair of circular deflector rings 61*a*, 61*b*, each being somewhat L-shaped in cross-section are disposed in cup 50 with ring 61*b* having its deflector plate portion 61*c* resting upon pedestals 63 formed integrally with the inner side wall surface of said cup 50. Deflector ring 61*a* is inverted with respect to deflector ring 61*b* so that its side wall 61*e* like side wall 61*d* of ring 61*a* lies against the side wall surface of cup 50 with said deflector ring side walls being in abutting engagement. The deflector plate portion 61*g* of ring 61*a* is thus disposed to extend over and to be in pressure engagement with the bottom edge of each vane 29 to form arcuate passageways 45 therebetween.

As best seen in FIG. 3A, the aforementioned fuel and air inlet head assembly 75 is securely fastened to the upper end of the tube 60, being operable to direct liquid fuel into the input of the fuming tank 16 as well as recirculated fuel from the liquid trap 24, and atmospheric air wherein the fuel is vaporized and mixed with air, a portion of which, as will be presently explained in greater detail, may be heated and obtained from the engine preparatory for introduction to the engine.

In its present configuration, as may be best seen in FIGS. 1 and 3A, the head assembly 75 comprises a T-shaped cap member 78 having its central stem part 79 mounted on the upper end of the tube 60. One end 80 of the transverse tubular part 81 of the T-shaped cap member 78 connects to one end of a flexible conduit 83, the opposite end of which connects to the air inlet 84 of the carburetor C in communication with the outlet side of the typical air cleaner D.

As seen in FIG. 1, carburetor C is intended to be sealed from atmosphere. Air entering the air cleaner D through its inlet funnel-shaped scoop S passes into and through flexible conduit 83 and into the inlet head assembly 75.

The opposite end 86 of the central bar part 81 of the cap member 78 connects to one end 90 of the central bar part of a T-shaped connector 92. The opposite end 93 of the central bar part connects to one end of flexible conduit 94, the opposite end of which connects to the outlet of the liquid trap 24.

The stem end 96 of the T-shaped connector 92 connects to one end of the aforementioned flexible conduit 26, the opposite end of which connects to the inlet of the carburetor C upstream of the typical butterfly valve.

As best seen in FIGS. 1A and 3, the fuming tank 16 is provided with an outlet port 103 which communicates with the annular chamber 40. Outlet port 103, as best seen in FIG. 3, is connected to one end 105 of the central bar part of the T-shaped connector 22. The opposite end 106 of said central bar part is connected to the inlet port 110 FIG. 7 of the liquid trap 24, the construction of the latter to be later described.

The stem end 112 of the T-shaped connector 22 connects to one end of the flexible conduit 114, the opposite end of said conduit connecting through T connector 107 and conduit 115 to the engine manifold M, as seen in FIG. 1.

As aformentioned, the fuming tank 16, FIG. 3, is under the influence of the engine vacuum such that as the misted or aspirated fuel and air mixture enters into tube 60, said mixture is rapidly sucked downwardly through said tube in the direction of arrows A and then passes at a substantially high velocity through the arcuate passageways 57 in the direction of arrows B, which causes a cyclonic or swirling effect to said mixture whereby, as understood, the heavier particles in said mixture are propelled toward the wall of the cup member 50.

This cyclone fuel-air mixture is drawn upwardly through the chamber 51 in the direction of the arrows C, passing around deflector plates **61*b* and 60*a* which acts to decrease the velocity of said mixture. This mixture then passes through the passageway 48 and into the arcuate passageway 45 in the direction of the arrows D. As a result the cyclonic effect is continued, and the fuel-air mixture exits from said passageways 45 into the upper part of the chamber 38, and into the narrow span 39 between the outer wall of cup 50 and shroud 23. The fuel-air mixture is then drawn downwardly through said space 39 under the influence of the engine vacuum through the chamber 38 in the direction of arrows E and thence outwardly into chamber 40 and through exit connector 22**.

Figure 6:
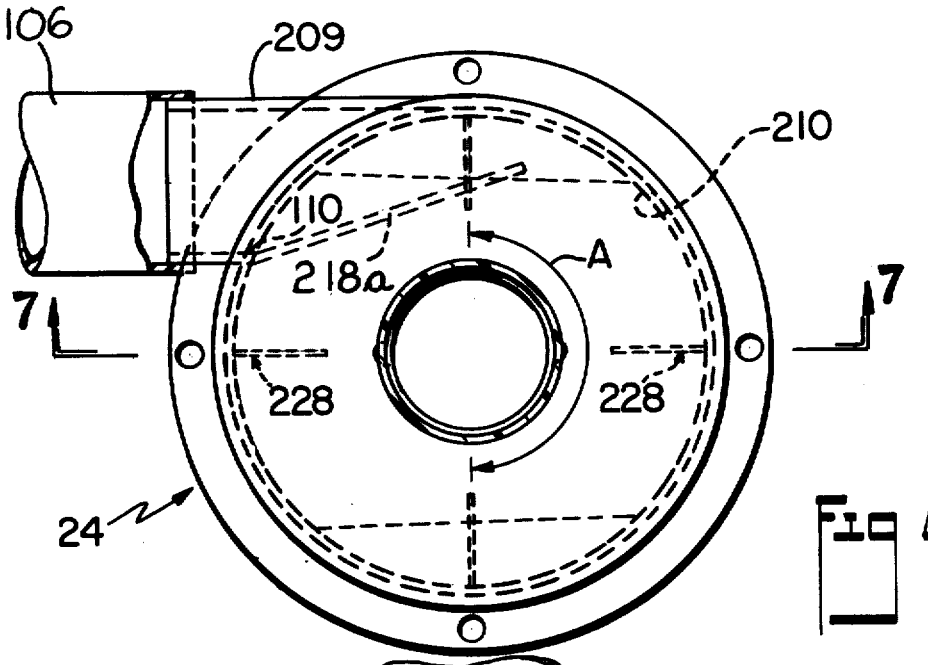
FIG. 6 is a top plan view of the liquid trap of the fuel system.
Figure 7:
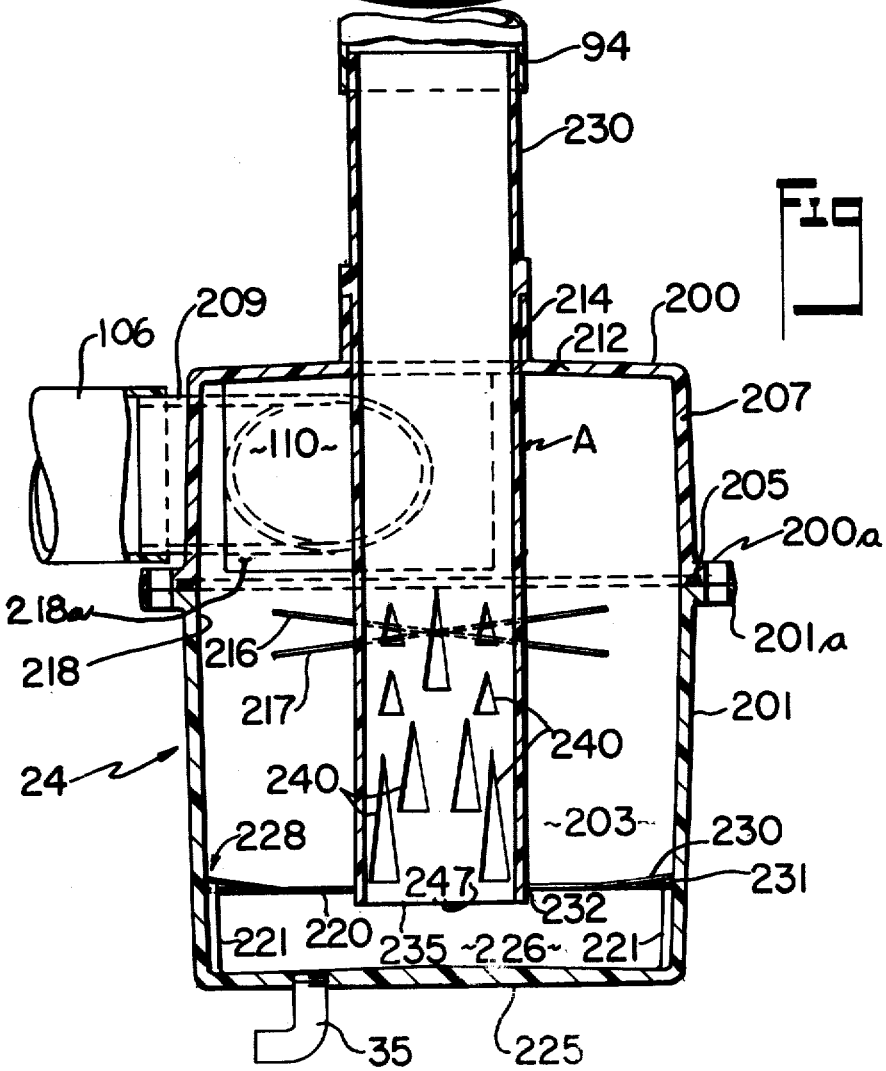
FIG. 7 is an elevational sectional view taken on line 7—7 of FIG. 6.

As seen in FIGS. 1A, 6 and 7, one end 106 of the T-shaped connector 22 is connected to the inlet port 110 of liquid trap 24 whereby the vaporized fuel-air mixture is presented to the trap which is then operable to withdraw therefrom any liquid fuel droplets which may still be in the mixture.

A preferred embodiment of liquid trap 24 is best illustrated in FIGS. 6 and 7 and is seen to comprise a cylindrical housing formed preferably of a plastic material like the material used for the fuming tank 16 and formed of an upper shell 200 and a lower shell 201 each having a peripheral flange **200*a*, 201*a* respectively formed on each of their open ends. Each shell 200, 201 is placed one upon the other with their peripheral flanges 200*a*, 201*a* abutting to thereby form housing chamber 203. The lower shell 201 is seen to be somewhat longer in its axial dimension. A suitable sealing means such as O-ring 205 disposed in groove 206 formed in the faces of flange 200*a*** may be interposed between said abutting flanges being operable to provide an air-tight seal therebetween.

The inlet port 110 of said trap is preferably formed in the side wall 207 of the upper shell 200 to which one end of an inlet tube 209 is attached.

The top wall 212 of the upper shell 200 is integrally formed with an upstanding flanged outlet port 214 which also communicates with the housing chamber 203.

The fuel-air mixture formed in fuming tank 16 is fed through connector 22 and inlet tube 209 to the chamber 203 of the liquid trap 24 wherein it is intended that the liquid droplets which still remain in said mixture are removed.

To accomplish this, inlet port 110 is formed in the side wall 207 such that the axis of inlet tube 209 is approximately tangent to and in close proximity to the inner chamber surface 210 and approximately transverse to the vertical axis of the trap 24. Deflector plate **218*a* formed integrally with the top wall 212 of shell part 200 extends downwardly and into chamber 203 and, as seen in FIG. 6, angles from one edge of inlet port 110 toward the side wall of said shell part 200. This deflector plate 218*a* directs the inlet flow of vaporous fuel and air toward said wall. With this construction and with the liquid trap 24 under the influence of the vacuum of the engine, as will be later described, as the fuel-air mixture enters into the chamber 203 it is substantially tangent to said inner surface such that said mixture moves circularly around said chamber the liquid droplets, being relatively heavier than the fuel-air vapor component of said mixture, impinges upon said surface and moves therealong and hence travels somewhat spirally by gravitation along and down said surface toward and into the bottom shell part 201**.

As best seen in FIG. 7, a pair of narrow deflection plates 216, 217 are disposed within the bottom shell part 201 adjacent the peripheral flange **201*a* being secured to the surface 218 thereof substantially diametrically opposite each other and exending transversely into the housing chamber 203. Each deflection plate 216, 217 projects angularly from one "high end" linearly downwardly into said chamber to a "lower end", said angulation being such as to direct the liquid fuel droplets downwardly into the lower shell part 201** wherein the same are separated from the fuel-air mixture.

To accomplish this, a flat circular plate 220 is suspended by posts 221 within chamber 203 being spaced above the bottom wall 225 of shell 201 substantially transversely to the axis thereof to define a reservoir 226 therebelow. As seen in FIG. 7, the diameter of the plate 220 is such that the periphery thereof is in close proximity to or slightly contacting the adjacent chamber surface 218.

As also seen in FIGS. 6 and 7, the plate 220 is partially sheared at two positions identified at 228, and extend from the periphery and project radially toward the plate center.

One of the sheared edges at each position, as identified at 230, is being upwardly to form a triangular opening 231.

With this construction, as the liquid droplets move downwardly along the chamber surface 218 or closely adjacent thereto, the direction of travel of said droplets is such that the same will pass through one of the plate openings 231 and thereby pass into the reservoir 226 formed therebelow.

The liquid droplets of fuel separated or trapped out of the vaporous fuel-air mixture passing through the liquid trap 24 collect in the bottom of the trap chamber and is then recycled back to the input of fuming tank 16 for vaporization through conduit 35, electric pump 36 and conduit 37.

In this manner, only the "dried out" vapor fuel-air mixture is delivered to the engine for consumption. It is intended that the electric pump 36 may be automatically manually or continuously actuated to recycle the separated liquid fuel droplets back to the input of the fuming tank 16.

The "dried out" vapor fuel-air mixture is directed to the input of the engine through conduit 26 for use in powering the engine.

For this purpose, a cylindrical tube 230 is disposed in the outlet port 214 and extends downwardly centrally into the chamber 203 and through a hole 232 formed in the plate 220. The diameter of said hole 232 is preferably such as to provide a slight clearance between the tube outer wall and the hole periphery. A flat plate 235 is placed over the bottom end of the tube 230, and has a small aperture 247 formed centrally therein.

As best seen in FIG. 7, a series of randomly shaped and spaced triangular shaped openings 240 are formed in the wall of the tube 230. It has been determined that the total area of said openings should be greater than the cross-sectional area of the interior of tube 230 to prevent any venturi action therein.

Said openings 240 are formed throughout the wall of said tube excepting for the wall section extending approximately 180° around the upper end thereof as identified at A in FIGS. 6 and 7. The tube 230 extends upwardly out of outlet port 214 and connects with one end of the aforementioned conduit 26 which, in turn, connects to the input of carburetor C. With this construction, the tube 230 and chamber 203 are connected to the engine vacuum.

In operation, the fuel-air mixture enters into chamber 203 through the inlet conduit 106 and is directed along the chamber wall 218. The section A of tube 230 is solid at this level thus preventing any of the fuel-air mixture from passing into the interior of said tube. As aforementioned, the liquid fuel droplets impinge upon the wall surface 218 and travel spirally therealong and downwardly through the chamber 203 whereby the same are separated from the fuel-air mixture by plate 220 in the manner as previously described.

The "dried out" vaporized fuel-air mixture within the chamber 203 is drawn into the tube 230 through the openings 240, and upwardly therethrough and out through the conduit 26 to the engine input.

As seen in FIG. 1, a flexible conduit 165 connects at one end to the engine manifold M and at its opposite end to T-connector 107. With this connection, hot air may be taken from manifold M, conduit 165, connector 107, flexible conduit 114, T-connector 22 to the input tube 106 of the liquid trap 24 wherein said hot air is added to the vaporous fuel-air mixture and is effective to maintain the vaporous condition of said mixture.

As also seen in FIG. 1, cold air from the air filter D is passed through conduit 83 to the T-connector 75 and conduit 90 to T-connector 92 whereat it joins with the aforedescribed vaporous "dried out" fuel-air mixture preparatory to its being delivered to the engine input.

A solenoid controlled air valve 250 is also mounted in the T-connector 92 and controls the opening and closing of a valve plate 251 which is operable to variably regulate the air in the fuel-air mixture delivered to the engine.

In this manner, only the "dried out" vapor fuel-air mixture is delivered to the engine for consumption. It is intended that the electric pump 36 may be automatically manually or continuously actuated to recycle the separated liquid fuel droplets back to the input of the fuming tank 16.

As previously mentioned, the present fuel system also incorporates an electronic monitor and control system which is operable to monitor a plurality of engine operating parameters and in response thereto to correspondingly control the mixture of said fuel and air and the delivery of said mixture to the engine so as to provide for an optimum combustionable mixture to be delivered to said engine under various load conditions. The present control system is an improvement over the control system as disclosed and claimed in the assignee's copending application, Ser. No. 173,605 filed on Aug. 1, 1980.

With reference directed to FIGS. 1 and 2, the electronic control system, as identified in its entirely by the reference 140, may be disposed within a suitable casing 141 which is mounted at a convenient location within the engine well as for example on the fire wall w.

In its present configuration, as best seen in FIG. 2, the control 140 receives four separate input signals from the engine which represent four separate engine operating parameters, i.e. engine RPM, engine coolant temperature, manifold vacuum and EGO (oxygen content in exhaust gases). These input signals are presented to the control and compared in a manner to be desdribed, and result in providing two separate output signals identified respectively as fuel flow regulator signal and air valve control signal which correspondingly regulate the fuel and air components of the fuel-air mixture delivered to the input of the engine. It is also to be understood that additional engine operating parameters may be utilized and presented to said control to provide for additional monitoring and control of the engine.

The control 140 disclosed herein is a "closed loop" system as will be understood in the art wherein a change in the load condition of the engine, as for example when the accelerator is depressed to increase engine speed, is sensed by the control which then operates to correspondingly adjust the fuel-air mixture to the engine and thus provide for a corresponding increase in engine speed. As the fuel-air mixture is adjusted to accommodate the changed load condition of the engine, the corresponding engine response, i.e. increase in engine speed, indicates the return of the fuel-air mixture to "optimum condition" which is then sensed by said control whereby it reverts to its standby or monitor mode to await the next change in engine operation.

Referring to FIG. 2, in the present engine control system, each of the engine parameter signals, i.e. engine RPM or throttle, engine coolant temperature, manifold vacuum and EGO (oxygen content in the exhaust gases) is an analog type voltage signal which is applied as a separate signal input to the control 140.

The engine RPM or throttle signal $S_1$ as graphically illustrated is seen to be substantially linear varying from an "idle throttle" condition as represented as 0.1 volt of a 5 volt range to approximately a 5 volt magnitude representing "full throttle".

This throttle signal may be produced in several ways, the one being presently utilized is to have a variable rheostat connected across the vehicle battery or any other suitable electrical power source with its variable element actuatable by the foot throttle whereby a voltage is provided to the control whose magnitude is dependent upon the adjusted position of the variable element. Such an adjustable voltage signal as aforesaid is illustrated by signal $S_1$.

The engine coolant temperature voltage signal is somewhat logarithmic in form as illustrated at $S_c$ in FIG. 2 varying exponentially from positive infinity at a low temperature to a relatively low voltage value at high temperature. Such a signal parameter may be obtained, as will be understood in the art, by utilizing a suitable thermistor connected across the vehicle battery or other suitable voltage source, and which monitors the temperature of the engine coolant by having a sensor probe exposed to the engine coolant wherein as the coolant temperature rises the output voltage signal of the thermistor correspondingly decrease logarithmically.

The manifold vacuum signal $S_v$ is obtained by using a sensor that provides a voltage signal which varies linearly in proportion to the vacuum magnitude. In the present system the signal $S_v$ varies between 0 and 5 volts D.C. for a vacuum varying between 0 and 25 inches of mercury, respectively. This sensor may be a barometric type or a solid state type as referred to in the art which senses a change in the vacuum and which, in turn, causes a corresponding change in its voltage signal output to the control.

The EGO signal (oxygen content in the exhaust gases) is obtained by using a suitable sensor element such as Oxygen Sensor No. ES-D9EE-9F472-AB manufactured by Ford Motor Company hereafter also called EGO sensor which may be conventionally located in the exhaust gaseous stream of the engine and therein capable of detecting the presence or absence of free oxygen in the exhaust gases. As will be understood in the art, the EGO sensor when connected across the vehicle battery is operable to emit a voltage signal that is indicative of the amount of free or uncombined oxygen in the exhaust gases and which signal is hence demonstrative of the fuel-air mixture being delivered to the engine. For example, if free oxygen is present in the exhaust gases it is an indication that too much air is in the fuel-air mixture input to the engine, and conversely if there is no free oxygen in the exhaust gases it is an indication of either that the fuel-air mixture is at its optimum wherein all oxygen is consumed or that insufficient air is present in the inlet fuel-air mixture which would then leave a certain trace of unburned fuel in the exhaust gases.

A typical signal response of the EGO sensor in FIG. 2 wherein a "rich" fuel-air mixture condition produces a somewhat rectangular signal "a" at a constant voltage magnitude so long as the "rich" mixture persists; an angularly-falling trailing edge as the "rich" mixture goes toward a "lean" mixture and thence a somewhat constant minimal voltage magnitude so long as the "lean" mixture condition persists.

In the present control the "optimum" fuel-air mixture is preferably selected to be "lean" or approximately 1 part fuel to 15 parts air by weight to thus cause a trace of free oxygen to be present in the exhaust gases but not of such quantity as to generate an intolerable level of nitrous oxide (NO). In the EGO sensor hereinabove identified this selected operating level usually provides an output voltage signal of above 50 millivolts.

As seen in FIG. 2, the above referred to engine operating signals $S_1$, $S_c$, $S_v$ and "a" are separately applied to the input of control 140.

Control 140 is provided with conventional analog to digital converter circuitry which is operable to convert said analog signals into digital output signals identified respectively as fuel flow regulator signal $F_s$ and air valve control signal $A_c$.

In the present configuration of system the fuel signal $F_s$ is connected to electric fuel pump 30 whereby the latter is variably pulsed on to periodically provide charges of liquid fuel into the input of the fuming tank or canister 16. The air signal $A_c$ is connectable to the solenoid controlled air valve 250 whereby the latter is variably responsive to the aforesaid engine parameter signals so as to correspondingly adjust valve plate 251 and provide the proper proportion of air to mix with the fuel being delivered to the carburetor and thus provide the optimum fuel-air mixture under various engine loading conditions.

With the control 140 connected into the system as above described, and with the engine initially running at idle, the quantitative output of the electric fuel pump 30 is adjusted along with the solenoid controlled air valve 250 so that the fuel-air mixture is optimum, i.e. 1 part fuel to 15 parts air by weight, and the resulting EGO sensor signal indicates that only a trace of unburned oxygen is present in the exhaust gases. The engine parameter signals, i.e. coolant temperature voltage $S_c$ and the engine vacuum signal $S_v$ are also combinable in control 140 with the EGO sensor signal to provide the output fuel and air signals $F_s$ and $A_c$ respectively which signals are utilized to pulse the fuel pump 30 and air solenoid 250 and provide adequate fuel and air respectively as aforesaid to maintain the proper proportion of fuel and air for said mixture.

In a typical situation, operation of the system is as follows.

The ignition is turned to the ON position and then to Start to actuate the engine. The control 140 monitors the ignition switch and responds to the starting of the engine to initially provide a slightly rich fuel-air mixture to the engine. The control continues to monitor the engine operation and as the temperature increases the control generates corresponding changes in the fuel signal $F_s$ and air signal $A_c$ to provide for a more lean fuel-air mixture. With the engine running at a typical temperature, if the throttle is depressed the change in throttle position is detected by throttle signal $S_1$ along with the consequent drop in engine vacuum and an increase in engine RPM which results in a new flow ratio of fuel and air in the mixture being delivered to the engine.

If the new flow ratio is too great it is detected by the EGO sensor and a consequent adjustment is then made by the control 140 to modify the fuel signal $F_s$ and the air signal $A_c$ thus resulting in maintaining the fuel-air ratio at the optimum for the load on the engine.

Having thus described the present invention in a preferred embodiment, it will be realized that modifications and changes may be made to the same without departing from the inventive concepts as are defined in the claims.

We claim:

1. A fuel system for use with an internal combustion engine having associated fuel delivery means and fuel ignitable means for power conversion comprising, a containable source for liquid ignitable fuel, a collector means communicating with said source for collecting fuel fumes or vapor adapted to emanate from said liquid ignitable fuel, means communicable with atmosphere and extending into the container source being operable to transmit air into said source above the liquid fuel therein for generating a fumed fuel-air mixture therefrom, means for generating a fumed fuel-air mixture from said collector means to the associated fuel delivery means of the engine for ignition therein, means coacting with the means communicable with atmosphere and responsive to actuation of the engine for insertion of liquid ignitable fuel into said communicable means for intermixing with intake air therein, means coacting with said communicable means for diffusing the fuel-air mixture entering into said containable source above the liquid fuel therein, trap means connectable to said collector means being operable to receive the vaporous fuel-air mixture and to separate therefrom droplets of fuel remaining in said vaporous mixture and to provide a dried-out vaporous mixture, and means connectible to the trap means and the fuel delivery means of said engine for transmitting the dried-out vaporous mixture to the latter and to thus provide the sole source of fuel to said engine, and electronic control means coacting with said engine and said fuel system being responsive to the operating load conditions of said engine to correspondingly control the fuel to air ratio of the mixture prior to the transmission of said mixture to said fuel delivery means of said engine effective to maintain said mixture as its optimum combustible composition.

2. A fuel system as defined in claim 1 and wherein electronic control means coact with said engine and said fuel system being responsive to the operating load conditions of said engine to correspondingly control the fuel to air ratio of the vaporous fuel-air mixture prior to the transmission of said mixture to said fuel delivery means of said engine effective to maintain said mixture at its optimum combustible composition.

3. A fuel system as defined in claim 2 and wherein the electronic control means includes at least one sensor means connectable to and operable to monitor the operation of said engine effective to provide a signal to said control and correspondingly adjust the fuel to air ratio of the fuel-air mixture delivered to said engine.

4. A fuel system as defined in claim 2 and wherein the electronic control means comprises a plurality of sensor means each connectable to the engine and operable to sense an operating parameter thereof and provide a signal to the control means effective to correspondingly adjust the fuel to air ratio of the vaporous fuel-air mixture delivered to said engine.

5. A fuel system as defined in claim 4 and wherein one of the sensor means is operable to sense the oxygen in the exhaust gases of said engine.

6. A fuel system as defined in claim 4 and wherein one of the sensor means is operable to sense the periodic operation of a moving part of said engine.

7. A fuel system as defined in claim 4 and wherein one of the sensor means is operable to measure the vacuum of said engine.

8. A fuel system as defined in claim 4 and wherein one of the sensor means is responsive to a temperature parameter related to the engine.

9. A fuel system as defined in claim 1 and wherein the trap means comprises tank means and means in said tank means operable to separate any droplets of fuel still remaining in the vaporous mixture delivered to said trap means.

10. A fuel system as defined in claim 9 and wherein the separating means in said tank means comprises inlet means for causing the vaporous mixture entering the trap means to separate by centrifugal force the fuel droplets from said vaporous mixture, and means intercepting said separated fuel droplets and operable to collect said droplets.

11. A fuel system as defined in claim 10 and wherein means are interconnectable between said separated fuel droplets and the collector means and thus recycled to the input of said fuel system.

12. A fuel system as is defined in claim 1 and wherein a means for generating a cyclonic action of the misted fuel-air mixture is provided in the collector means and comprises tank means disposed in said collector means and having means for receiving the misted fuel-air mixture and effective to generate the cyclonic action therein.

13. A fuel system as is defined in claim 12 and wherein the receiving means comprises vane means operable to generate a cyclonic action.

14. A fuel system as defined in claim 1 and wherein upper and lower vane means are disposed in said collector means effective to swirl the misted fuel-air mixture and generate therefrom a vaporous fuel-air mixture.

15. A fuel system as defined in claim 14 and wherein the upper and lower vane means are disposed in spaced relation to each other and positioned to serially receive the misted fuel-air mixture.

16. A fuel system as defined in claim 1 and wherein means connectable with the collector means and trap means operate to return the separated fuel droplets to the collector means.

* * * * *